US010980688B1

(12) United States Patent
Albahkali et al.

(10) Patent No.: US 10,980,688 B1
(45) Date of Patent: Apr. 20, 2021

(54) HOSPITAL BED WITH PIVOTING SIDE RAIL

(71) Applicant: KING SAUD UNIVERSITY, Riyadh (SA)

(72) Inventors: Thamer Ali Albahkali, Riyadh (SA); Hany Hassan Aly Sayed, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/810,784

(22) Filed: Mar. 5, 2020

(51) Int. Cl.
*A47D 13/06* (2006.01)
*A47D 13/00* (2006.01)
*A61G 7/05* (2006.01)

(52) U.S. Cl.
CPC ..... *A61G 7/051* (2016.11); *A61G 7/0506* (2013.01)

(58) Field of Classification Search
CPC ..... A47D 7/005; A47D 7/007; A47D 7/04; A47D 7/00; A47D 13/06; A47D 13/063; A47D 13/066
See application file for complete search history.

(56) References Cited

U.S. PATENT DOCUMENTS 793,168 A * 6/1905 Abrams ..... A47D 7/04 5/81.1 HS
949,389 A * 2/1910 Almgren ..... A47D 7/02 5/93.1
3,344,445 A 10/1967 Crawford
4,573,608 A * 3/1986 Hansen ..... A47D 5/003 221/92
4,688,844 A 8/1987 Hirose et al.
5,745,936 A 5/1998 Van McCutchen et al.
6,032,310 A * 3/2000 Helmsderfer ..... A47D 5/003 5/136
6,269,503 B1 * 8/2001 Betker ..... A47D 5/003 5/655
6,611,973 B2 * 9/2003 Connell ..... A47C 17/86 16/35 R
6,848,129 B1 * 2/2005 Amato ..... A47D 7/02 5/97
8,646,127 B1 * 2/2014 Lytle ..... A47D 7/02 5/655

(Continued)

FOREIGN PATENT DOCUMENTS

EP 2425804 A1 3/2012
WO 2018003367 A1 1/2018

*Primary Examiner* — Peter M. Cuomo
*Assistant Examiner* — Ifeolu A Adeboyejo
(74) *Attorney, Agent, or Firm* — Nath, Goldberg & Meyer; Richard C. Litman

(57) ABSTRACT

The hospital bed with pivoting side rail includes a bed frame having a headboard, a footboard and a platform mounted thereon. The side rail has an upper end, a lower end, and first and second longitudinally opposed sides. The lower end of the side rail is pivotally attached to the bed frame, and the upper end of the side rail is releasably attached to the headboard and the footboard. In order to safely and easily deploy and collapse the side rail, first and second adjustable struts are provided, the struts having opposed first and second ends, such that the first ends of the first and second adjustable struts are pivotally attached to the first and second sides of the side rail, and the second ends of the first and second adjustable struts are pivotally secured to the headboard and footboard, respectively.

4 Claims, 2 Drawing Sheets

(56) References Cited

U.S. PATENT DOCUMENTS

| | | | | |
|---|---|---|---|---|
| 2008/0209632 | A1* | 9/2008 | Presnell | A47D 5/003 5/136 |
| 2011/0030143 | A1* | 2/2011 | Estrada | A61G 7/053 5/613 |
| 2012/0084916 | A1* | 4/2012 | Flannery | A47D 15/00 5/426 |
| 2013/0019402 | A1* | 1/2013 | Vervoort | A47C 21/028 5/412 |
| 2013/0185867 | A1* | 7/2013 | Long | A47D 13/083 5/95 |
| 2015/0135433 | A1 | 5/2015 | Jei | |
| 2015/0272339 | A1 | 10/2015 | Sanchez Zarza | |

* cited by examiner

HOSPITAL BED WITH PIVOTING SIDE RAIL

BACKGROUND

1. Field

The disclosure of the present patent application relates to hospital beds, and particularly to a hospital bed with pivoting side rail.

2. Description of the Related Art

Hospital and patient beds are often equipped with side rails for patient safety, the side rails preventing the patient from accidentally rolling over and falling out of bed. Such beds are single beds, and generally only have sufficient room for the patient to lie either prone or supine. When the patient is bedridden for several days, simple hygiene requires that the bed linen be changed to reduce the possibility of infection from bacteria or viruses, which are often prevalent in hospitals, nursing homes, and other health care facilities. When the patient is ambulatory, or is capable of occupying a wheelchair, arrangements may be made for cleaning the bed when it is unoccupied. However, when the patient is relatively immobile (e.g., comatose, paralyzed, etc.), the process of changing the bed linen may require other measures that require more manpower and resources, such as a team of orderlies to lift the patient from a bed to a gurney while the room is being cleaned.

It would be beneficial to modify the structure of the traditional hospital bed to provide a space for temporarily moving and supporting the patient with a minimum of time and effort to afford an opportunity for performing customary hygiene measures. Thus, a hospital bed with pivoting side rail solving the aforementioned problems is desired.

SUMMARY

The hospital bed with pivoting side rail is a hospital bed or other patient bed suitable for a health care facility having a side rail that can be selectively pivoted into a position substantially parallel to the bed frame, thus forming a shelf or table-like extension for moving a patient in the bed during a change of the bed's sheets. The side rail has an upper end, a lower end, and first and second longitudinally opposed sides. The lower end of the side rail is pivotally attached to the bed frame, and the upper end of the side rail is releasably secured to a headboard and footboard attached to the bed frame. The upper end of the side rail may be releasably attached to the bed frame using one or more locking mechanisms. A pair of such locking mechanisms may be provided for releasably securing the upper end of the side rail to both the headboard and the footboard.

In order to safely and easily deploy and collapse the side rail, first and second adjustable struts are provided, which may be in the form of telescopic tubes, gas struts (also commonly referred to as "gas springs"), hydraulic dampers or the like. Each of the first and second adjustable struts has opposed first and second ends, such that the first ends of the first and second adjustable struts are pivotally attached to the first and second sides of the side rail, and the second ends of the first and second adjustable struts are pivotally attached to the headboard and footboard, respectively.

When the side rail is fully deployed, each of the first and second adjustable struts are extended to a maximum length, which corresponds to the side rail being oriented parallel to the bed frame. Thus, the first and second adjustable struts prevent the side rail from being angled downward from the horizontal plane, preventing the patient from accidentally falling out of the bed. The first and second adjustable struts also ease and regulate the collapse and deployment of the side rail so that it is not performed in a manner that would startle or potentially injure the patient.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
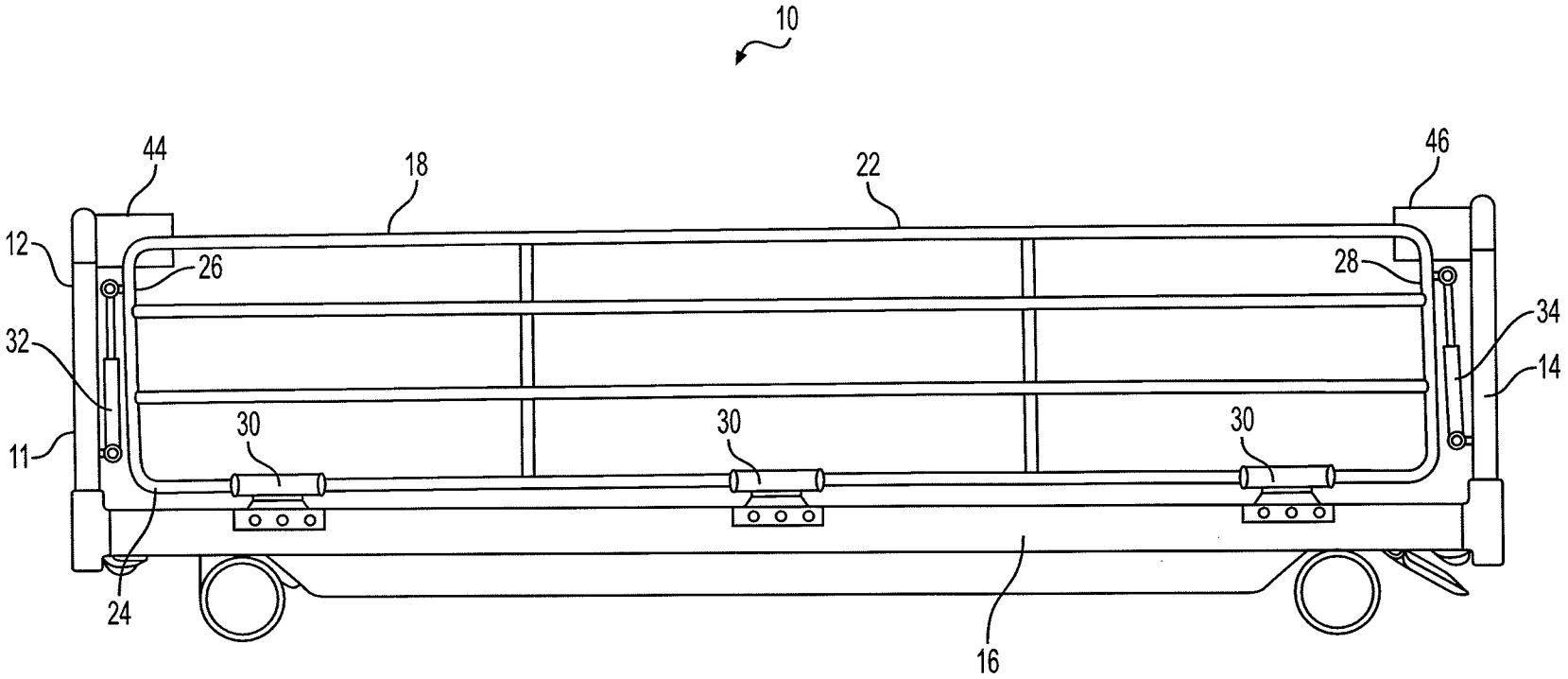
FIG. 1 is a side view of a hospital bed with pivoting side rail, shown with the side rail raised.
Figure 2:
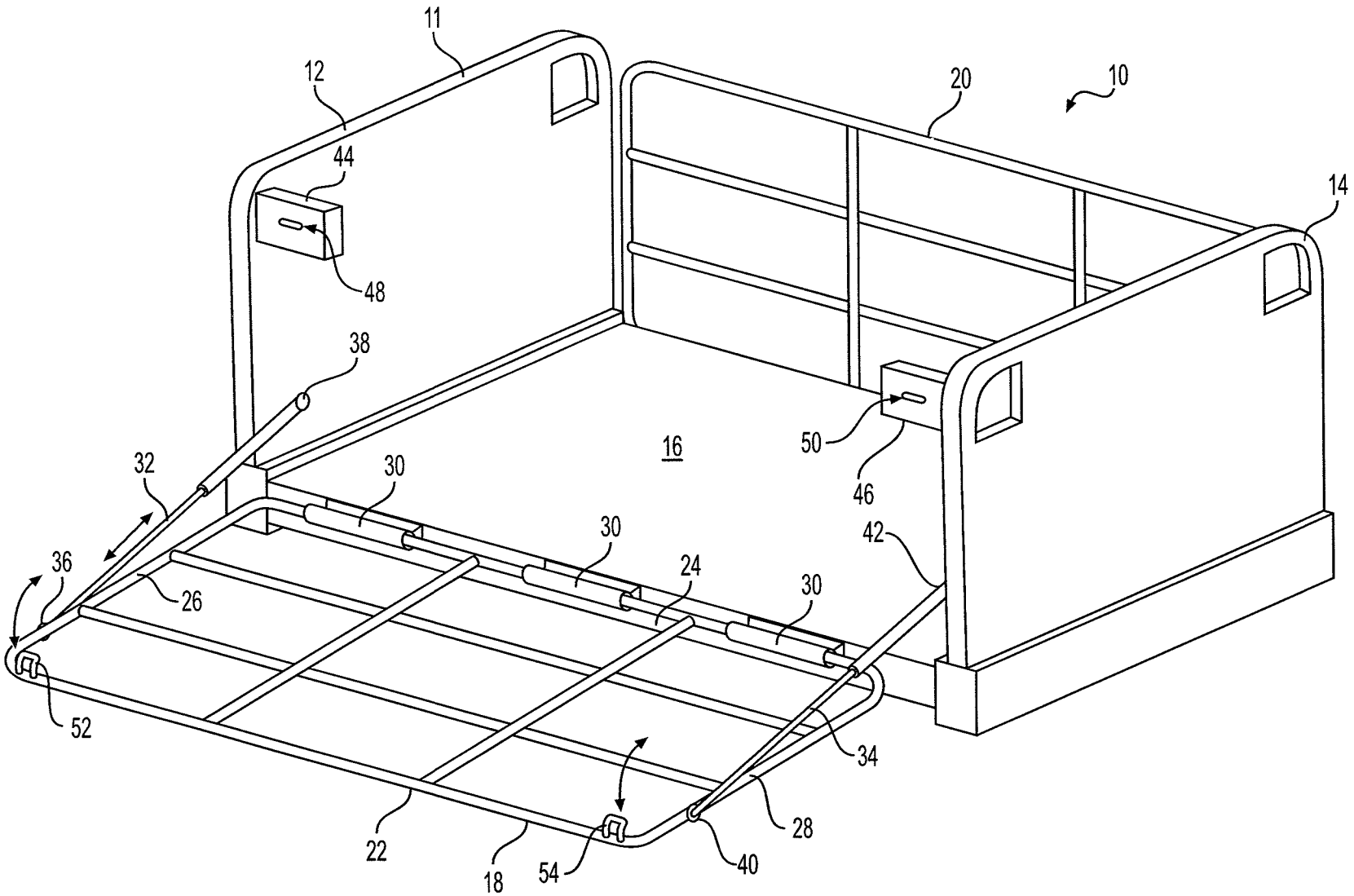
FIG. 2 is a perspective view of the hospital bed of FIG. 1, shown with the side rail pivoted down.

The hospital bed with pivoting side rail, designated generally as 10 in the drawings, is a hospital bed or other patient bed suitable for a health care facility having a side rail 18 that can be selectively pivoted from a fully upright position (as shown in FIG. 1) into a position which is substantially parallel to the bed frame, as shown in FIG. 2. In the fully deployed position of FIG. 2, side rail 18 forms a shelf or table-like extension for moving a patient in the bed 10 during a change of the bed's sheets. As best seen in FIG. 2, the bed frame includes a rectangular frame and has a headboard 12 and a footboard 14 mounted at opposite ends of the rectangular frame, and a platform 16 mounted on the rectangular frame. It should be understood that the headboard 12, the footboard 14, the platform 16 and the side rail 18 are shown for exemplary purposes only, and may have any suitable overall shape, style and relative dimensions. It will be further understood that the hospital bed 10 shown in the drawings is mounted on hydraulic lift cylinders hidden below the platform (see, e.g., FIG. 2 of International Patent Application PCT/JP2017/019707, published as WO 2018/003367, which is hereby incorporated by reference in its entirety) that may raise the bed frame to a desired height, but the frame of the hospital bed 10 may be mounted on any desired legs or posts at any desired height. Further, although only the pivoting of side rail 18 is described below, it should be understood that side rail 20 may also be operated in an identical manner or, alternatively, side rail 20 may be a conventional side rail.

Side rail 18 has an upper end 22, a lower end 24, and first and second longitudinally opposed sides 26, 28, respectively. The lower end 24 of the side rail 18 is pivotally attached to a perimeter rail of the bed frame by hinges 30 or the like. It should be understood that hinges 30 are shown for exemplary purposes only, and that any suitable form of pivotal attachment may be used. The upper end 22 of the side rail 18 is releasably attached to the headboard 12 and the footboard 14, respectively. It should be understood that the upper end 22 of the side rail 18 may be releasably attached to the headboard 12 and the footboard 14 using any suitable type or number of locking mechanisms or other releasable attachments. In FIGS. 1 and 2, locking mechanisms 44, 46 are shown including brackets extending from the headboard 12 and footboard 14, respectively, each having a slot 48, 50, respectively, for receiving a corresponding hook 52, 54, respectively, attached to the upper end 22 of side rail 18. The locking mechanisms 44, 46 and the corresponding hooks 52, 54 provide a releasable lock similar to that found in car trunks, for example, although, as noted above, it should be understood that the upper end 22 of the side rail 18 may be releasably attached to the headboard 12 and footboard 14, respectively, using any suitable type or number of locking mechanisms or other releasable attachments.

In order to safely and easily deploy and collapse the side rail 18, first and second adjustable struts 32, 34, respectively, are provided, which may be in the form of telescopic tubes, gas struts (also commonly referred to as "gas springs"), hydraulic dampers or the like. First ends 36, 40 of the first and second adjustable struts 32, 34, respectively, are pivotally attached to the first and second sides 26, 28, respectively, of the side rail 18. Second ends 38, 42 of the first and second adjustable struts 32, 34, are pivotally attached to the headboard 12 and footboard 14, respectively.

When the side rail 18 is fully deployed, as shown in FIG. 2, each of the first and second adjustable struts 32, 34 is extended to a maximum length, which corresponds to the side rail 18 being oriented parallel to the platform 16 mounted on the bed frame 11. Thus, the first and second adjustable struts 32, 34 prevent the side rail 18 from being angled downward from the horizontal plane, preventing the patient from accidentally falling out of the bed 10. The first and second adjustable struts 32, 34 also ease and regulate the collapse and deployment of the side rail 18 so that it is not performed in a manner that would startle or potentially injure the patient.

It is to be understood that the hospital bed with pivoting side rail is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A hospital bed with pivoting side rail, comprising:

a bed frame having a headboard, a footboard and a platform mounted thereon, wherein each of the headboard and footboard includes a locking bracket;

a side rail having an upper end, a lower end, and first and second longitudinally opposed sides, the lower end being pivotally attached to the bed frame, and the upper end being releasably attached to the headboard and the footboard, wherein the upper end of the side rail includes a pair of locking mechanisms for releasably attaching to a respective locking bracket disposed on the headboard and footboard; and first and second adjustable struts each having opposed first and second ends, the first ends of the first and second adjustable struts being pivotally attached to the upper half of the first and second sides, respectively, of the side rail, the second ends of the first and second adjustable struts being pivotally attached at an inside face inward of the lower half of the headboard and the footboard, respectively.

2. The hospital bed as recited in claim 1, wherein each of the first and second adjustable struts comprises a telescopic tube.

3. The hospital bed as recited in claim 1, wherein each of the first and second adjustable struts comprises a gas strut.

4. The hospital bed as recited in claim 1, wherein each of the first and second adjustable struts has a maximum extended length corresponding to the side rail being oriented parallel to the bed frame when the side rail is in a fully deployed state.

* * * * *